United States Patent [19]

Horne et al.

[11] 4,344,567

[45] Aug. 17, 1982

[54] HYDRAULIC HEATING SYSTEM

[76] Inventors: C. James Horne, Box 184, Rte. 113, Lederach, Pa. 19450; Edward A. Duffy, P.O. Box 100, Kulpsville, Pa. 19443

[21] Appl. No.: 221,593

[22] Filed: Dec. 31, 1980

[51] Int. Cl.[3] ..... F28C 3/00

[52] U.S. Cl. ..... 237/1 R; 122/26; 126/247

[58] Field of Search ..... 122/26; 126/247; 237/1 R

[56] References Cited

U.S. PATENT DOCUMENTS

| | | | |
|---|---|---|---|
| 797,847 | 8/1905 | Gilroy | 126/247 |
| 823,856 | 6/1906 | Gilroy | 126/247 |
| 1,031,489 | 7/1912 | Thomson | 122/26 |
| 2,764,147 | 9/1956 | Brunner | 122/26 |
| 3,720,372 | 3/1973 | Jacobs | 122/26 |
| 3,813,036 | 5/1974 | Lutz | 237/1 R |
| 3,952,723 | 4/1976 | Browning | 237/1 R |
| 3,989,189 | 11/1976 | Kita | 237/1 R |
| 4,060,194 | 11/1977 | Lutz | 237/1 R |
| 4,143,522 | 3/1979 | Hamrick et al. | 126/247 |
| 4,277,020 | 7/1981 | Grenier | 126/247 |

*Primary Examiner*—William R. Cline
*Assistant Examiner*—John F. McNally
*Attorney, Agent, or Firm*—David H. Semmes

[57] ABSTRACT

Liquid heating systems employing a circulating oil which is forced through a baffle having restricting orifices, so as to develop heat of friction and shear. The system is characterized by the employment of a plurality of orifices in the restricting baffle, each orifice being angularly disposed with respect to the axis of flow. The oil is heated by frictional impact of restricted flow through the orifices. The angular disposition of the orifices effects supplemental heating of the oil by the shear effect of the pressurized oil advancing through the static or depressurized oil adjacent the anterior side of the baffle.

9 Claims, 11 Drawing Figures

RADIATOR SYSTEM

FORCE AIR SYSTEM

RADIANT HEAT

HOT WATER HEATER

FORCED HOT AIR

DEGREE DEFLECTION FROM PARALLEL TO FLOW INCREASES TEMP. AT SAME PRESSURE. ALSO SAME FLOW AREA.

CHANGE IN FLOW AREA AT SAME ANGLES EFFECTS TEMP. ALSO SMALLER AREA = LONGER HEAT TIME.

HYDRAULIC HEATING SYSTEM

BACKGROUND OF THE INVENTION (1) Field of the Invention

Liquid heating systems, particularly a closed conduit oil circulating heat exchange system. A pressurizing pump flows the oil through a baffle having angularly disposed restricting orifices, thereby developing heat of friction and heat of shear within the flowing oil. The system may be coupled to a radiator or radiant heat system, a forced air duct system or a hot water heater, and the like.

(2) Description of the Prior Art

GILROY, U.S. Pat. No. 823,856
BRUNNER, U.S. Pat. No. 2,764,147
JACOBS, U.S. Pat. No. 3,720,372
LUTZ, U.S. Pat. No. 3,813,036
BROWNING, U.S. Pat. No. 3,952,723
KITA, U.S. Pat. No. 3,989,189
LUTZ, U.S. Pat. No. 4,060,194
HAMRICK, U.S. Pat. No. 4,143,522

The foregoing patents are discussed in an accompanying PRIOR ART STATEMENT.

Basically, the prior art teaches the forcing of liquid through a restrictor, so as to obtain frictionally generated heat. However, the prior art does not show the angularization of the orifices with respect to the axis of flow, so as to obtain the enhanced effect of shearing of the flowing liquid with respect to the non-flowing or static liquid, adjacent the posterior side of the orifice.

SUMMARY OF THE INVENTION

According to the present invention, a closed, oil-filled conduit defines a hydraulic pressurizing section and a depressurized return section for liquid oil flow. A vertical baffle is supported within the conduit intermediate the pressurizing section and the return section, the baffle including a plurality of perforations or orifices angularly disposed with respect to the axis of the conduit. An oil pressurizing pump is supported in the conduit on the anterior side of the baffle, so as to force the oil through the angularly disposed orifices. The liquid oil medium, preferably vegetable oil, is flowed thusly through the baffle orifices and the conduit by means of the pump, the oil being heated by the frictional impact of restricted flow through the orifices and the shear of the flowing oil against non-flowing or static oil adjacent the posterior side of the baffle. The system may be coupled with a radiator or radiant heating systems, a forced air duct system or a hot water heater, and the like.

DESCRIPTION OF THE PREFERRED EMBODIMENTS

Figure 1:
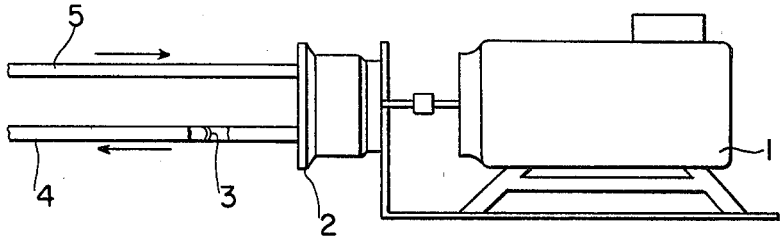
FIG. 1 is a fragmentary schematic view, showing positioning of an electric motor and pump with respect to the pressurizing and return sections of the conduit, as well as the vertical baffle interposed between the pressurizing and return sections.

In FIG. 1 there is illustrated a conventional electric motor 1, (one horsepower 1725 rpm, 10 amps) coupled with a hydraulic pump 2, for example, a Gressen hydraulic pump Model PGG2 bidirectional. The closed conduit system includes pressurizing section 4 and depressurized return section 5, together with a vertical baffle 3 positioned within the conduit so as to intersect oil flow. Both sections of the conduit may contain pressurometers, as well as oil filling apertures (not illustrated) and the hydraulic pump may contain conventional valves.

Figure 2:
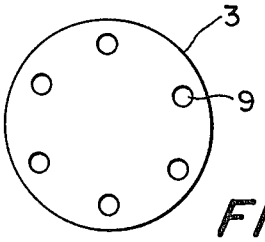
FIG. 2 is a front elevation of a baffle having angularly disposed restricting orifices, constructed according to the present invention.
Figure 3:
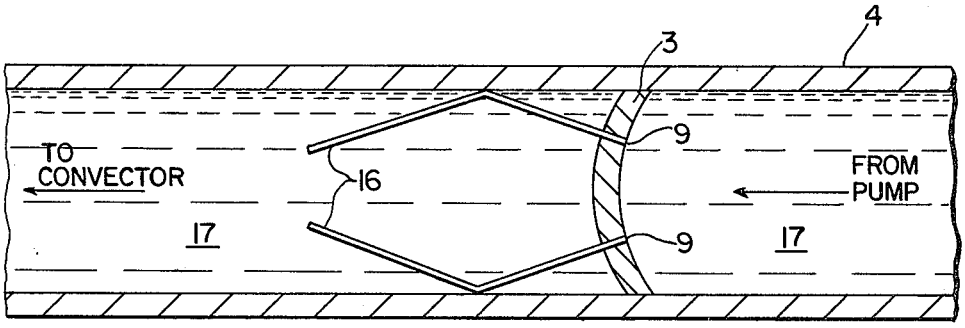
FIG. 3 is a fragmentary schematic view, illustrating the interposition of a concave baffle in the conduit, so as to obtain oil flow deflected against the conduit wall.
Figure 4:
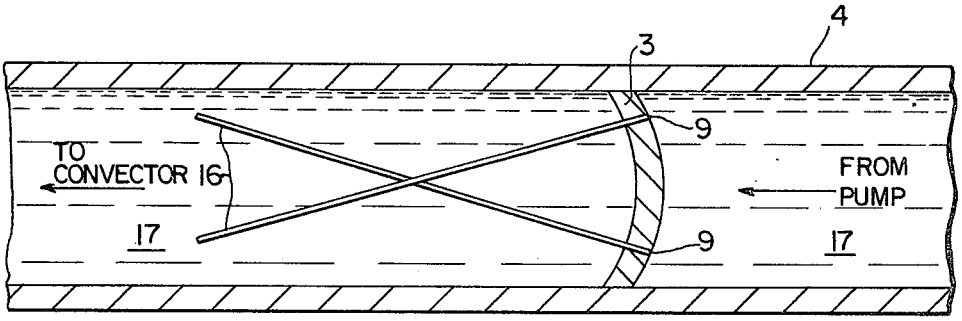
FIG. 4 is a fragmentary schematic view, showing positioning of a convex baffle, so as to obtain intersecting oil flow within the return section of the conduit.
Figure 5:
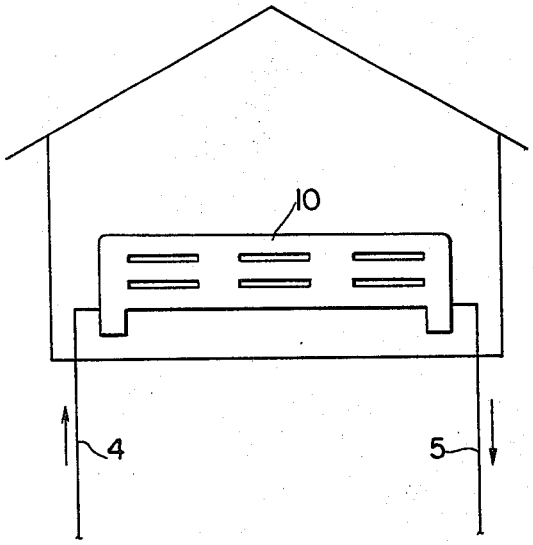
FIG. 5 is a schematic view, showing the present system coupled to a home radiator system.
Figure 6:
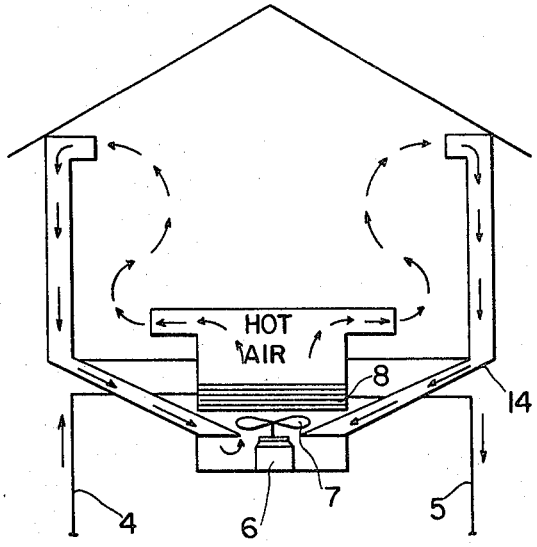
FIG. 6 is a schematic view, showing the coupling of the present hydraulic heating system to a home forced air system.
Figure 7:
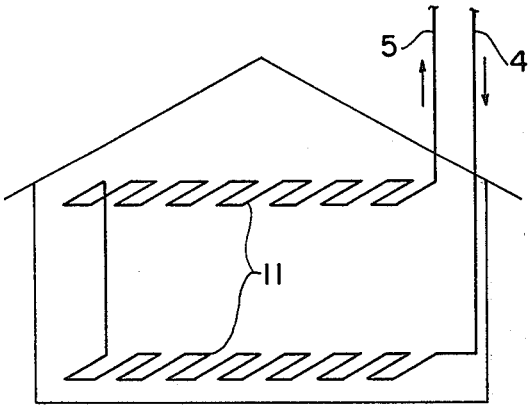
FIG. 7 is a schematic view, showing coupling of the present system to a radiant heating system.
Figure 8:
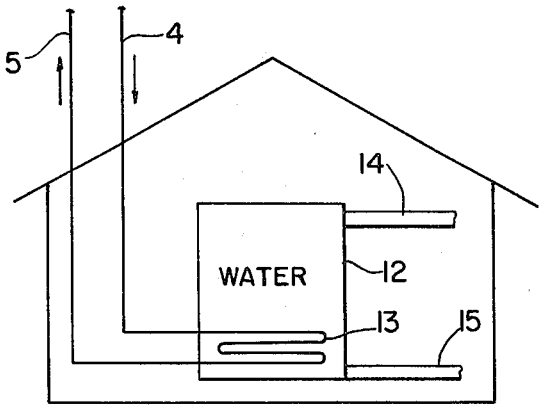
FIG. 8 is a schematic view, showing coupling of the present system to a hot water heater.
Figure 9:
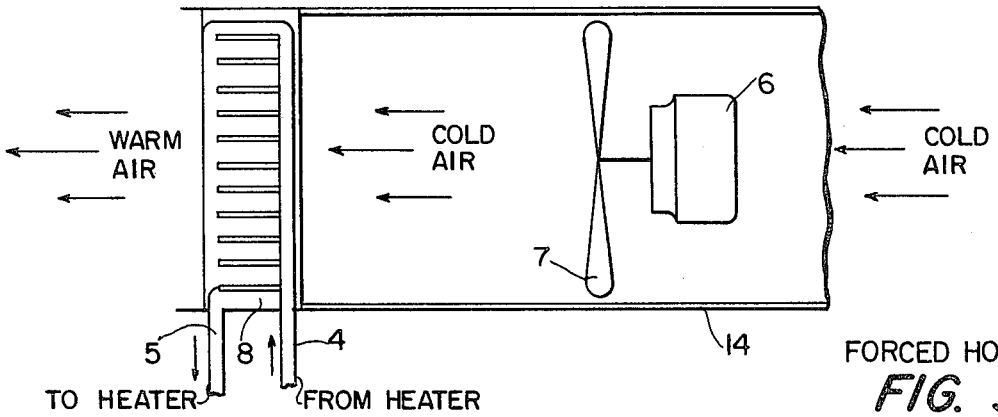
FIG. 9 is a schematic view, showing coupling of the present system to a forced hot air system.
Figure 10:
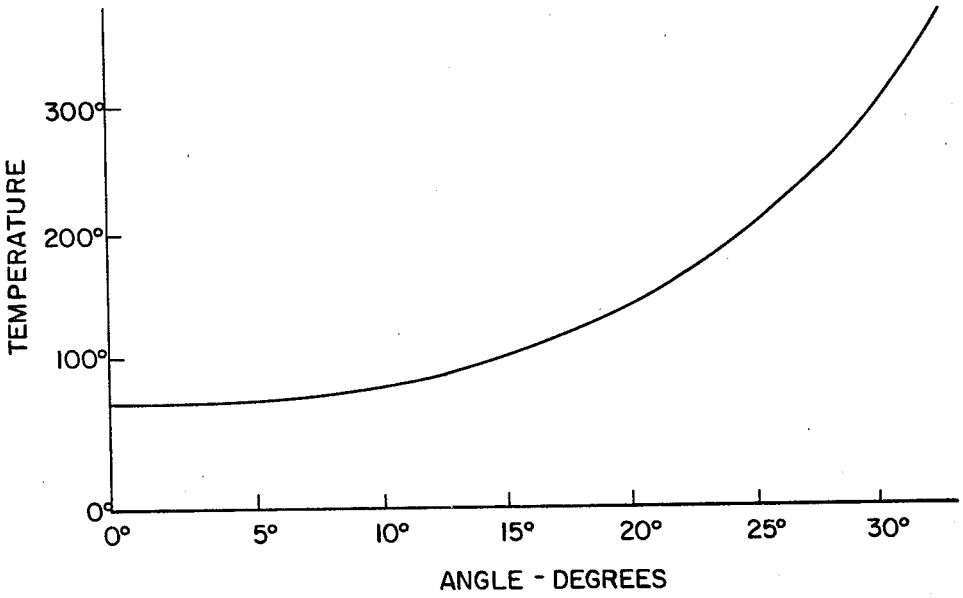
FIG. 10 is a graph, illustrating the effect of increasing temperature of the oil at constant pressure, according to the increasing angularity of the orifice with respect to the axis of flow.
Figure 11:
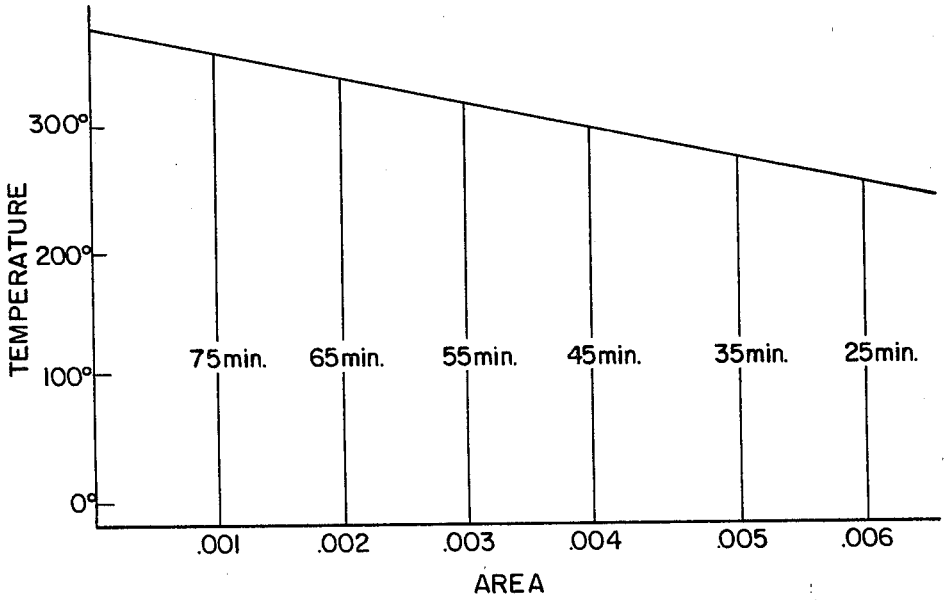
FIG. 11 is a graph illustrating the effect of reducing the time sequence for flowing of the oil at constant pressure to achieve a desired temperature by increasing the area of restricted flow through a plurality of angularly disposed orifices.

As illustrated in FIG. 2, baffle 3 may include a plurality of angular displayed orifices or perforations 9. In the species illustrated in FIG. 3, baffle 3 has a concave cross-section with respect to direction of oil flow, such that the pressurized oil is forced in high velocity streams 16 which deflect against the conduit wall. The frictional resistance upon urging of the liquid oil through the orifices 9, as well as the shear effect between flowing streams 16 and the static or slow moving fluid 17 adjacent baffle 3, develops considerable heat. In the version illustrated in FIG. 4, a convex baffle 3 is employed, so as to develop intersecting high velocity streams 16 on the posterior side of the baffle.

A number of vegetable, mineral and animal oils have been employed as follows:

| | |
|---|---|
| Corn oil | Palm oil |
| Sunflower seed oil | Castor oil |
| Soya bean oil | Hempseed oil |
| Vegetable oil | Camphor oil |
| Olive oil | Plant oil |
| Rapeseed oil | Mineral oil |
| Peanut oil | Animal oils |
| Sesame oil | Lemon oil |
| Tallow oil | Fruit oils |
| Animal fat oils | Bees' wax |
| Cottonseed oil | Pepper oil |
| Coconut oil | Blubber oil |
| Linseed oil | Butter |
| Parafin oil | Cod Liver oil |
| Sperm oil | Musk oil |
| Lanolin oil | Pine oil |
| Safflower oil | Petroleum, heavy, medium, |

-continued

| light (all types) |
|---|

As will be apparent from the following chart A, the vegetable oil achieved 212° F. in lesser time than the petroleum oil.

CHART A

| Oils Tested | Starting Temperature | Pressure (in PSI) | Temperature (in Degrees) | Elapsed Time (Minutes) | Air Temperature |
|---|---|---|---|---|---|
| | ELAPSED TIME TO ACHIEVE OIL TEMPERATURE OF 212° F. | | | | |
| Corn | 70 | 210 | 212 | 6.7 | 125 |
| Safflower | 70 | 210 | 212 | 7.0 | 125 |
| Sunflower | 70 | 210 | 212 | 7.1 | 125 |
| Olive | 70 | 205 | 212 | 7.1 | 125 |
| Soya | 70 | 205 | 212 | 7.2 | 123 |
| Vegetable | 70 | 205 | 212 | 7.3 | 123 |
| Peanut | 70 | 205 | 212 | 7.3 | 122 |
| Cod Liver | 70 | 200 | 212 | 7.4 | 122 |
| Mineral | 70 | 190 | 212 | 7.5 | 121 |
| Castor | 70 | 185 | 212 | 7.6 | 120 |
| Petroleum | | | | | |
| Heavy | 70 | 180 | 212 | 15.5 | 115 |
| Medium | 70 | 160 | 212 | 20.0 | 110 |
| Light | 70 | 140 | 212 | 23.0 | 105 |

In Chart B there is illustrated heating of corn oil by pumping through a single 0.006 inch orifice, 210° F. being achieved in ten minutes.

CHART B

HEATING OF CORN OIL PUMPING THROUGH .006 ORIFICE

| Time Fan (Minutes) | Pressure In | Pressure Out | Oil Median Temp In | Oil Median Temp Out | Air Temp In | Air Temp Out | Amperes |
|---|---|---|---|---|---|---|---|
| 0 | 0 | 0 | 70 | 70 | 70 | 70 | 0 |
| 5 | 210 | 0 | 140 | 136 | 72 | 76 | 10 |
| 10 | 210 | 0 | 210 | 206 | 75 | 78 | 10 |
| 15 | 210 | 0 | 230 | 226 | 77 | 80 | 10 |
| 20 | 210 | 0 | 250 | 246 | 79 | 82 | 10 |
| 25* | 220 | 0 | 200 | 196 | 75 | 160 | 10 |
| 30* | 220 | 0 | 142 | 138 | 72 | 130 | 10 |
| 35* | 220 | 0 | 142 | 138 | 70 | 125 | 10 |
| 40* | 220 | 0 | 142 | 138 | 70 | 125 | 10 |
| 45* | 220 | 0 | 142 | 138 | 70 | 125 | 10 |
| 50* | 220 | 0 | 142 | 138 | 70 | 125 | 10 |
| 55* | 220 | 0 | 142 | 138 | 70 | 125 | 10 |
| 60* | 220 | 0 | 142 | 138 | 70 | 125 | 10 |

*These readings stayed constant for 20 hours with no change and the corn oil was clear.

In Chart C a larger 0.008 inch orifice was employed with consequent loss in heating effect.

CHART C

HEATING OF CORN OIL PUMPING THROUGH .008 ORIFICE

| Time Fan (Miuntes) | Pressure In | Pressure Out | Oil Median Temp In | Oil Median Temp Out | Air Temp In | Air Temp Out | Amperes |
|---|---|---|---|---|---|---|---|
| 0 | 0 | 0 | 70 | 70 | 70 | 70 | 10 |
| 5 | 60 | 0 | 135 | 131 | 73 | 77 | 10 |
| 10 | 60 | 0 | 169 | 165 | 75 | 79 | 10 |
| 15 | 60 | 0 | 195 | 191 | 77 | 80 | 10 |
| 20 | 60 | 0 | 212 | 208 | 79 | 85 | 10 |
| 25 | 60 | 0 | 230 | 226 | 78 | 90 | 10 |
| 30* | 80 | 0 | 197 | 193 | 70 | 125 | 10 |
| 35* | 80 | 0 | 137 | 133 | 70 | 118 | 10 |
| 40* | 80 | 0 | 137 | 133 | 70 | 118 | 10 |
| 45* | 80 | 0 | 137 | 133 | 70 | 118 | 10 |
| 50* | 80 | 0 | 137 | 133 | 70 | 118 | 10 |
| 55* | 80 | 0 | 137 | 133 | 70 | 118 | 10 |
| 60* | 80 | 0 | 137 | 133 | 70 | 118 | 10 |

*These readings stayed constant for 10 hours.

In any case the pressure drop within the oil on the posterior side of the baffle, achieves a heat discharge which may be coupled with various radiator, forced air, radiant heating, hot water heater and like systems, illustrated in FIGS. 5, 6, 7 and 8.

The angular displacement of the orifices with respect to the axis of the conduit has significant effect upon the ability to develop heat within the oil medium. See by way of example, Chart D.

CHART D

HEAT OUTPUT Vegetable Oil

| Pressure Before Restriction | Flow Area In .001ths. Inches | Angular Displacement of High Velocity Stream | Output BTU' |
|---|---|---|---|
| 40 psi | 12 × .098 | ∠ = 1.87° | 5,000 |
| 43 psi | 12 × .094 | ∠ = 3.75° | 10,000 |
| 45 psi | 10 × .098 | ∠ = 7.5° | 20,000 |
| 47 psi | 10 × .094 | ∠ = 11.25° | 30,000 |
| 50 psi | 9 × .098 | ∠ = 15° | 40,000 |
| 55 psi | 9 × .094 | ∠ = 18.75° | 50,000 |
| 60 psi | 8 × .098 | ∠ = 22.25° | 60,000 |
| 65 psi | 8 × .094 | ∠ = 26.25° | 70,000 |
| 70 psi | 7 × .098 | ∠ = 30° | 80,000 |
| 75 psi | 7 × .094 | ∠ = 33.75° | 90,000 |
| 80 psi | 6 × .098 | ∠ = 37.5° | 100,000 |
| 100 psi | 6 × .094 | ∠ = 45° | 120,000 |
| 160 psi | 5 × .098 | ∠ = 52.5° | 140,000 |
| 180 psi | 5 × .094 | ∠ = 60° | 160,000 |
| 200 psi | 4 × .098 | ∠ = 67.5° | 180,000 |
| 210 psi | 4 × .094 | ∠ = 71.4° | 200,000 |

As will be apparent, the greater the angle of the orifice with respect to the axis of the conduit, the greater the heat developed through friction and shear effect.

Manifestly, various types of baffles may be employed and the number of orifices may be varied without departing from the spirit and scope of invention.

We claim:

1. A hydraulic heating system comprising:

A. a closed conduit defining an hydraulic pressurizing section and a depressurized return section;

B. a baffle supported perpendicularly within said conduit intermediate said pressurizing section and said return section, said baffle including a plurality of orifices in the size range 0.094–0.098" and said orifices being disposed with respect to the longitudinal axis of said conduit at an angle in the range 30°–71°;

C. an oil pressurizing pump supported in said conduit on the anterior side of said baffle, so as to flow oil through said orifices at a pressure in the range 70–220 p.s.i.;

D. a liquid oil medium supported within said conduit and flowed through said baffle by means of said pump, said oil being heated both by the frictional impact of restricted flow through said orifices and the shear of flowing oil against non-flowing oil on the posterior side of said baffle.

2. An hydraulic heating system as in claim 1 wherein said oil is a vegetable oil from the group consisting of:

| | |
|---|---|
| Corn oil | Palm oil |
| Sunflower seed oil | Castor oil |
| Soya bean oil | Hempseed oil |
| Vegetable oil | Camphor oil |
| Olive oil | Plant oil |
| Rapeseed oil | Peanut oil |
| Sesame oil | Lemon oil |
| Tallow oil | Fruit oils |
| Cottonseed oil | Pepper oil |

-continued

| | |
|---|---|
| Coconut oil | Linseed oil |
| Butter | Parafin oil |
| Lanolin oil | Pine Oil |
| Safflower oil | |

3. An hydraulic heating system as in claim 1 wherein said oil is petroleum from the group consisting of heavy, medium and light types.

4. An hydraulic heating system as in claim 1 wherein said oil is an animal oil from the group consisting of animal fat, sperm oil, bees' wax, blubber oil, cod liver oil and musk oil.

5. An hydraulic system as in claim 2 wherein said baffle has a concave profile with respect to the flow of oil within said conduit, such that the flow of oil on the posterior side of said baffle is deflected against said conduit wall.

6. An hydraulic heating system as in claim 2, wherein said baffle has a convex profile with respect to the direction of flow, such that the flow of oil through said orifices and into said depressurized return section is intersecting on the posterior side of said baffle.

7. An hydraulic heating system as in claim 2, wherein said return section of said conduit is coupled to a radiator heating system.

8. An hydraulic heating system as in claim 2, wherein said return section of said conduit is coupled to a heat transfer core and a forced air heating system.

9. An hydraulic heating system as in claim 2, wherein said return section of said conduit is coupled with a hot water heater.

* * * * *